United States Patent [19]

Ohkawara et al.

[11] 4,145,146

[45] Mar. 20, 1979

[54] RECORDING MEDIUM FEEDING APPARATUS FOR PRINTER

[75] Inventors: Yasuo Ohkawara, Sayama; Nagao Mizutani, Hachiouji; Toshio Kurihara, Tokorozawa; Masamitsu Nojima, Tokyo, all of Japan

[73] Assignee: Citizen Watch Co. Ltd., Tokyo, Japan

[21] Appl. No.: 745,978

[22] Filed: Nov. 29, 1976

[30] Foreign Application Priority Data

Nov. 29, 1975 [JP] Japan ..... 50-143052

[51] Int. Cl.[2] ..... B41J 15/00

[52] U.S. Cl. ..... 400/614; 400/124; 400/158; 400/605

[58] Field of Search ..... 197/114 R, 126 R, 126 A, 197/132, 133 R, 134, 151; 226/121, 157; 242/68.2, 72 R, 72.1

[56] References Cited

U.S. PATENT DOCUMENTS

| | | | |
|---|---|---|---|
| Re. 14,283 | 4/1917 | Hart | 197/132 |
| 807,894 | 12/1905 | Wood et al. | 197/133 R |
| 980,275 | 1/1911 | Ireland | 197/133 R |
| 1,034,058 | 7/1912 | Bates | 197/114 R |
| 1,142,005 | 6/1915 | Yaw | 197/132 |
| 1,432,169 | 10/1922 | Fenn et al. | 197/132 |
| 1,806,200 | 5/1931 | Hart | 197/132 |
| 2,096,509 | 10/1937 | Garbell | 197/132 X |
| 2,170,696 | 8/1939 | Rhodes | 197/114 R X |
| 2,922,592 | 1/1960 | Kaltenbach | 242/68.2 |
| 3,100,037 | 8/1963 | Green et al. | 197/127 R |
| 3,154,185 | 10/1964 | Kamp | 197/151 |
| 3,174,611 | 3/1965 | Lapointe | 197/151 |
| 3,593,833 | 7/1971 | Bretti | 197/132 |
| 3,837,461 | 9/1974 | Waibel | 197/126 A |

FOREIGN PATENT DOCUMENTS

| | | | |
|---|---|---|---|
| 542596 | 1/1932 | Fed. Rep. of Germany | 197/114 R |

OTHER PUBLICATIONS

IBM Technical Disclosure Bulletin, "Carbon Ribbon Take-up Clutch Powered By Extension Spring", Mimlitch, vol. 8, No. 11, Apr. 1966, pp. 1625, 1626.

*Primary Examiner*—Ernest T. Wright, Jr.
*Attorney, Agent, or Firm*—Sherman & Shalloway

[57] ABSTRACT

A recording medium feeding apparatus for printer is disclosed wherein a web of a recording medium is fed and taken up by a take up reel. A web feeding mechanism and a reel driving mechanism are operated through a coupling means by a spring means in which energy is stored by a common driving means.

12 Claims, 7 Drawing Figures

RECORDING MEDIUM FEEDING APPARATUS FOR PRINTER

BACKGROUND OF THE INVENTION

This invention relates to a recording medium feeding apparatus for a printer for printing letters and/or symbols at a high speed on a web of a recording medium wound as a roll.

Heretofore, in the high speed printers of this type, independent driving means for feeding and winding-up the recording medium and movable receiving means for receiving the printing force applied by a printing head to the recording medium have been employed. Further, feeding and winding-up of the recording medium which is wound in a roll is accomplished by a pintrack type feeding means. So as to maintain an accurate amount of feeding, and winding-up, separate means have been proposed. While the provision of an independent winding-up means facilitates the construction of the printer, there have been various disadvantages such that provision of independent driving means not only makes the printer larger in its size but also complicates the driving circuit, thus requiring a larger driving power source. Moreover, the aforementioned pintrack type feeding means requires perforation on the recording medium, which results in increased costs of supplies and cost of the feeding means itself.

SUMMARY OF THE INVENTION

It is therefore an object of this invention to provide an improved printer having a simple construction, which can be manufactured at a low cost, is reliable and can obviate the disadvantages described above.

Another object of this invention is to provide an improved printer capable of printing letters or the like on a web of continuous recording medium wound as a roll.

Still another object of this invention is to provide an improved printer in which the exchange of a roll of the recording medium can be made readily.

Still further object of this invention is to provide an improved printer which prevents inaccurate operation of the recording medium wound as a roll caused by excessive winding up of the recording medium by rotation inertia of a winding shaft. It is another object of this invention to provide a release of locking means upon energy accumulation so that precise feeding and winding amount of the recording medium wound as a roll may be performed.

According to this invention, there is provided a printer comprising a web of recording medium, means for feeding the web, means for driving the feeding means, means for taking up the web fed by the feeding means, means for driving the take-up means, means for coupling the means for driving the feeding means with the means for driving the take-up means, and means for storing resilient force in the means for driving the feeding means and in the means for driving the take-up means.

BRIEF DESCRIPTION OF THE DRAWING

Further objects and advantages of the invention can be more fully understood from the following detailed description taken in conjunction with the accompanying drawing in which.

DESCRIPTION OF THE PREFERRED EMBODIMENT

Figure 1:
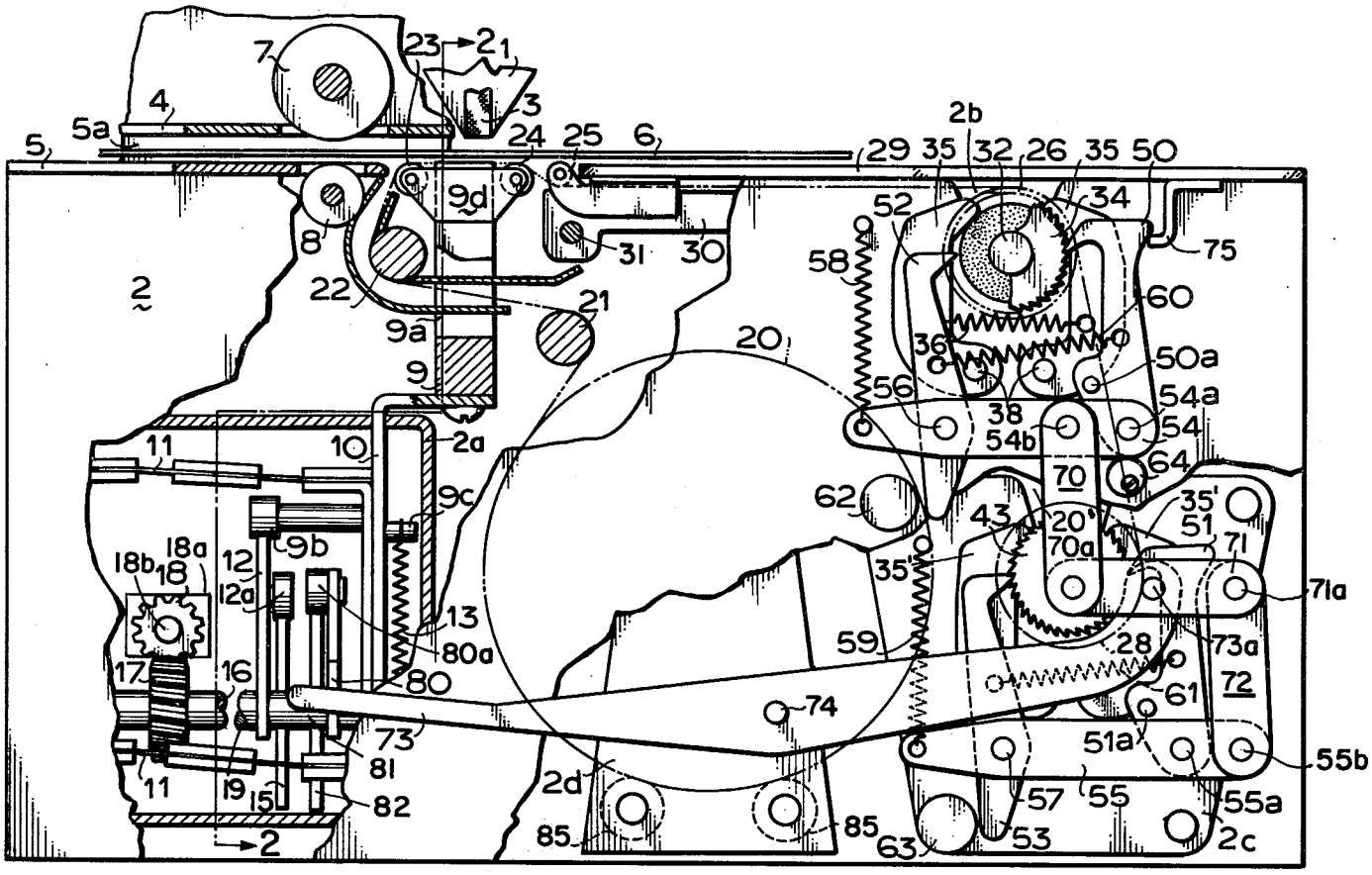
FIG. 1 is a side view, partly in section, of one embodiment of the printer of this invention.

The printer shown in the accompanying drawing comprises a printing head 1 such as a dot matrix type printing head. The printing head 1 is supported by a frame 2 so as to run along a line to be printed. An inking ribbon 3 is supplied to the tip of the printing head 1 by a suitable mechanism not shown. A positioning member 4 for a first recording medium 6 is secured to the frame 2 adjacent to the path of travel of the printing head 1. A receiver 5 for receiving the first recording medium 6 is secured to the frame 2 to form a space **5*a* between it and the positioning member 4 to receive the first recording medium 6 which is fed by a feed roller 7 in coorporation with a follower roller 8. If desired, the follower roller 8 can be urged against the feed roller 7 by a suitable driving means, not shown, for clamping the recording medium 6 therebetween. A printing bed 9 provided with a recess 9*a* is disposed to face the printing head 1. During the printing operation, the printing bed 9 is operated to urge the recording medium 6 against the lower surface of the positioning member 4 so as to receive via the inking ribbon 3 and the recording medium 6 the impact force of the printing head 1 running along a path spaced a predetermined distance from the lower surface of the positioning member 4. The printing bed 9 is supported by the frame 2 by well known parallel leaf springs 11 through an angle member 10 so that the printing bed 9 can approach the printing head 1. The printing bed 9 movable in unison with the angle member 10 is provided with a roller 9*b* adapted to engage a driving member 12 for the printing bed 9. A pin 9*c* secures one end of a spring 13. The other end of the spring 13 is secured to the frame 2. The spring 13 functions to urge the roller 9*b* against the driving member 12 against the force of the parallel leaf springs 11 and has a resiliency sufficient to hold the printing bed 9 in the position shown in the drawing in which the printing bed 9 is in a waiting position for inserting the recording medium 6 in the space 5*a***.

Figure 2:
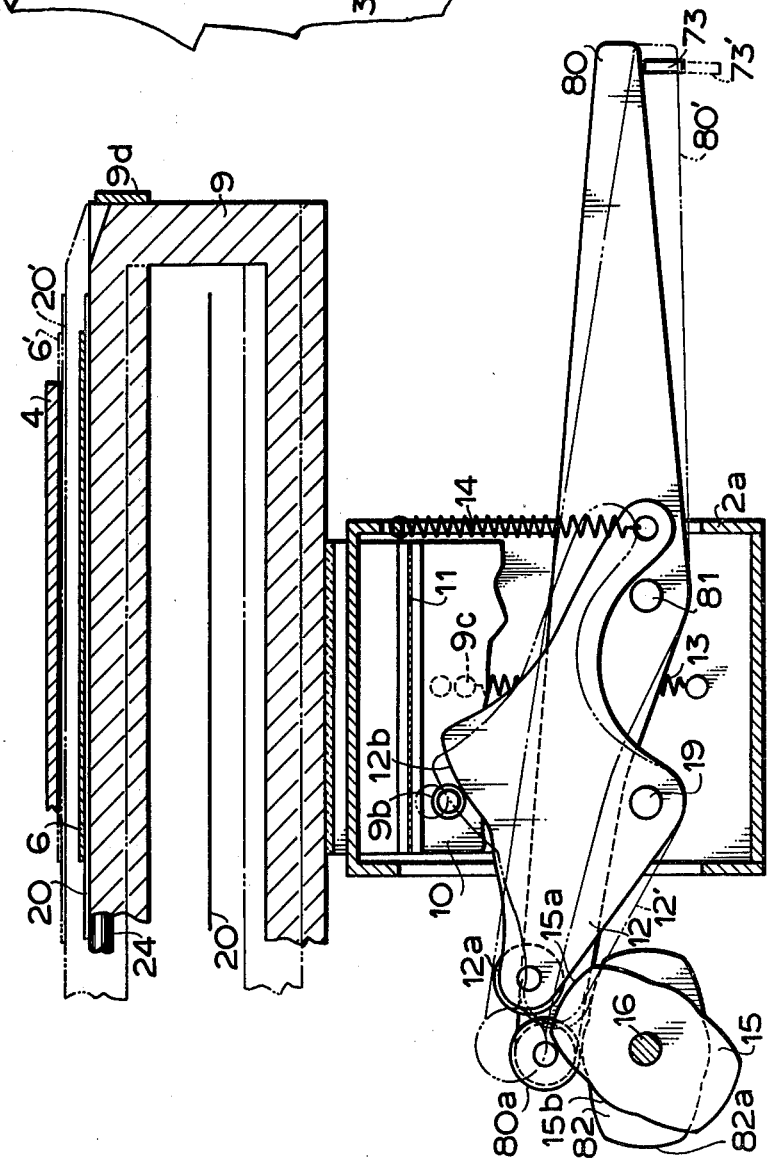
FIG. 2 is a sectional view of driving means of the conveyor means of the printer shown in FIG. 1 taken along a line 2—2.

As shown in FIG. 2, the driving member 12 for the printing bed 9 is pivotally mounted on a pin 19 secured to a portion **2*a* of frame 2. The driving member 12 is provided with a cam follower 12*a* which is urged against a driving cam 15 by means of a spring 14 with one end secured to the frame portion 2*a*. The driving member 12 is formed with a cam portion 12*b* for displacing the roller 9*b* in the vertical direction as the driving cam 15 rotates. The cam 15 is mounted on a cam shaft 16 journalled by the frame portion 2*a* and provided with two high portions 15*a* and two low portions 15*b* symmetrically disposed with respect to the cam shaft 16**.

Referring again to FIG. 1, a worm wheel 17 is secured to the cam shaft 16 to mesh a worm 18 driven by an electric motor **18*a*, connected to shaft 18*b*. The motor 18*a*, worm 18, worm wheel 17, driving cam 15, cam follower 12***a*, spring 14 and the driving member 12 for the printing bed 9 constitute a printing bed driving means.

Figure 3:
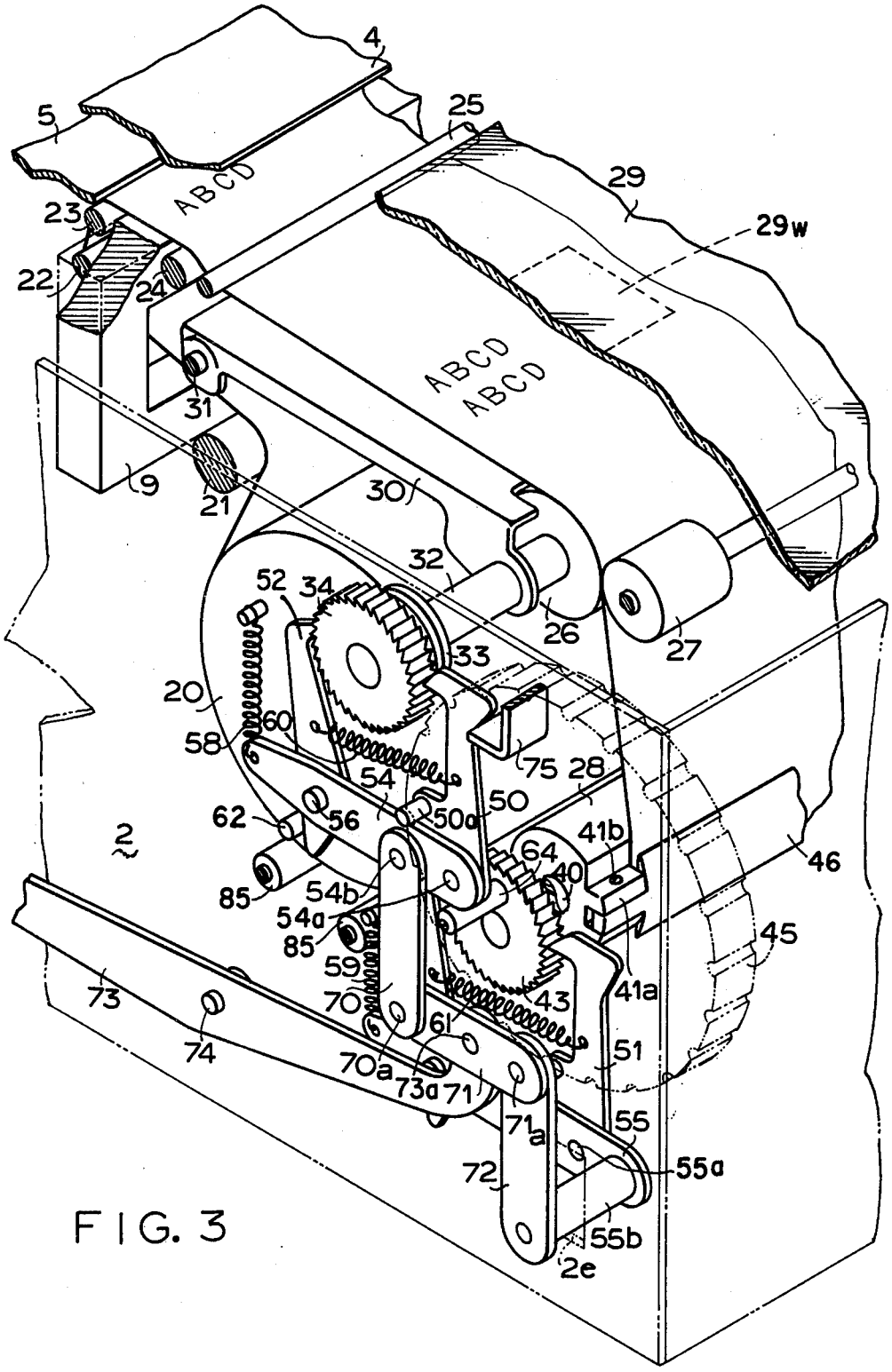
FIG. 3 is a perspective view showing the conveyor means shown in FIG. 1.

As shown in FIG. 3, a web of a second recording medium 20 comprising a self colouring pressure sensitive sheet of paper wound as a roll is fed by a feed mechanism comprising a feed roller 26 and a pressing roller 27 via guide rollers 21, 22, 23, 24 and 25 which are supported by the frame 2 and then taken up by a reel 28.

As shown in FIG. 1 the guide rollers 23 and 24 are rotatably supported by a mounting member 9*d* secured to both sides of the printing bed 9. A transparent protective cover 29 is provided to check the result of printing of the second recording medium 20. The cover 29 is also used to support the first recording medium 6.

At one end of the cover 29, is provided the guide roller 25, and at the other end is provided the pressing roller 27 (Refer to FIG. 3) which is supported to resiliently engage the feed roller 26. The cover 29 is removably mounted on the frame 2 so as to insert and remove the second recording medium 20 after it has been taken up about the reel 28. As shown in FIG. 3, a feed roller supporting member 30 is pivotally mounted on a pivot pin 31 secured to the frame 2 and rotatably supports a feed shaft 32 for the feed roller 26. The supporting member 30 is used to also support the recording medium 20. Thus, when a window 29*w* (shown in phantom in FIG. 3) provided for the cover 29 is opened it is possible to write some remarks on the recording medium 20. A bearing 33 and a ratchet wheel 34 are mounted on one end of the feed shaft 32.

Figure 5:
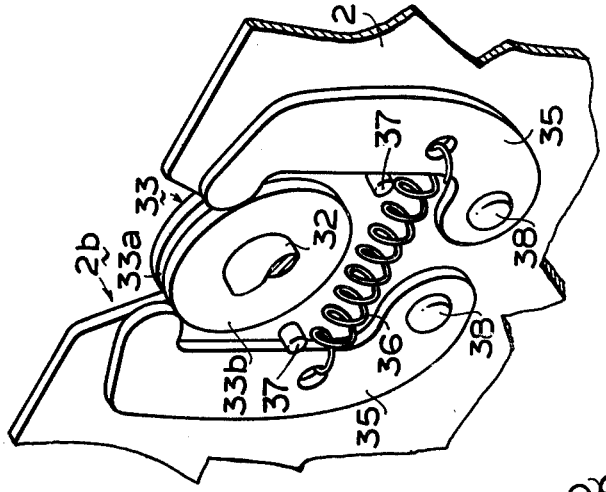
FIG. 5 is a partial perspective view showing a manner of supporting the shaft of the feeding means.

As shown in FIG. 5, the bearing 33 is provided with a groove 33*a* for receiving the edges of a notch 2*b* of frame 2. A pair of locking members 35 are secured to the frame 2 by means of pins 38 so as to resiliently clamp a top 33*b* of the bearing 33 between the free ends of the locking members 35 by means of a spring 36. This construction permits ready mounting and dismounting of the feed shaft 32 to and from the frame 2. Even when the feed shaft 32 is dismounted from the frame 2 together with the bearing 33, the locking members 35 are held by stoppers 37 secured to the frame 2 so that it is possible to readily reinsert the feed shaft 32 and the bearing 33.

Figure 4:
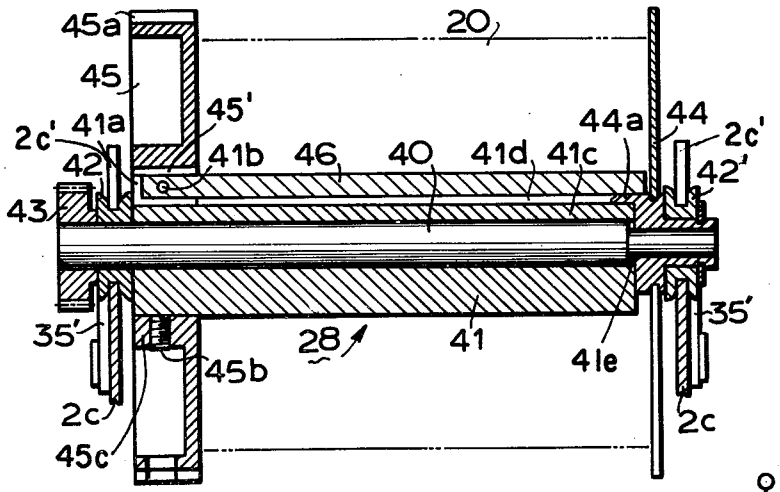
FIG. 4 is a sectional view of a take-up reel.

Turning now to FIG. 4, a shaft 40 supports a cylindrical drum 41 with an opening 41*e* and a ratchet wheel 43, and a rotatable bearing 42 is provided between the drum 41 and ratchet wheel 43 on one end of the shaft 40. A flange 44 removable in the axial direction is mounted on the other end. A bearing 42' is rotatably mounted to secure the shoulder 44*a* of the flange 44 to the shaft 40. An adjustable flange 45 is provided with grooves 45*a* on its peripheral surface, an opening 45' and a bushing 45*c* provided with a screw 45*b*. Thus, the adjustable flange 45 is secured to the drum 41 by the screw 45*b* to position the flange 45 with respect to the flange 44 so as to take up the recording medium 20 under a desired condition. The adjustable flange 45 can be secured to any position according to the width of the recording medium 20. One end of a movable member 46 is pivotally secured to the projections 41*a* of the take-up drum 41 by means of a pin 41*b* and the other end engages the shoulder 44*a* of the flange 44. A gap 41*d* defined by the movable member 46, the flange 44 and an axial notch 41*c* on the periphery of the drum 41 is used to insert the edge of the recording medium 20. When the flange 44 and shoulder 44*a* are removed after taking up the recording medium 20 on the drum 41, the movable member 46 can pivot around pin 41*b* in a direction toward drum 41 to reduce the total diameter of the reel 28 thus releasing the roll of the recording medium 20 from the take-up drum 41. Accordingly, it is possible to dismount the recording medium 20 by moving flange 44 to the right. The bearing 42 engages a notch 2*c'* of the frame portion 2*c* and is resiliently engaged by a locking member 35' (see FIG. 1). The reel 28 is provided with bearings similar to the feed bearing 33, which are removably mounted on shaft 40. The flange 45 has an opening 45' for receiving movable member 46 and reel 28. A bushing 45*c* surrounds the opening 45' and has a means 45*b* for coupling the flange 45 through the bushing 45*c* to the reel 28.

As shown in FIG. 1, rollers 85 are rotatably mounted on a frame portion 2*d* for rotatably supporting the recording medium 20 in the form of a roll for permitting it to rotate smoothly when it is fed by the feed mechanism described above. The rollers 85 are arranged such that the roll of the recording medium 20 to be printed can be stably supported when its diameter is minimum. The frame portion 2*d* is constructed to mount the recording medium 20 on a desired position of frame 2.

The ratchet wheels 34 and 43 have the same construction and are provided with pawls 50 and 51 for driving and pawls 52 and 53 for preventing reverse rotation of the ratchet wheels 34 and 43. The pawls 52 and 53 are operated by levers 54 and 55 which are supported by stationary shafts 56 and 57 respectively carried by the frame 2 and the frame portion 2*c*.

The ends of the levers 54 and 55 respectively are held by springs 58 and 59 having the same spring constant so as to operate the pawls 50 and 51 to rotate the ratchet wheels 34 and 43 in the clockwise direction. The pawls 50 and 51 are connected to the levers 54, 55 through pins 54*a* and 55*a*. The pawls 52 and 53 utilized to prevent reverse rotation of the ratchet wheels 34 and 43 are rotatably supported by the stationary shafts 56 and 57, respectively. The ends of springs 60 and 61 are connected to the pawls 50 and 51 respectively, whereas the other ends are connected to the pawls 52 and 53, respectively so as to bias the pawls 50, 51 and 52, 53 toward each other thus causing them to positively engage the ratchet wheels 34 and 43, respectively.

When the feed shaft 32 is dismounted from the frame 2 together with the ratchet wheel 34, the pawl 50 and the pawl 52 for preventing the reverse rotation of the ratchet wheel 34 are biased toward each other by the spring 60 but the stopper 50*a* on the pawl 50 comes to engage the lever 54 thus limiting excessive displacement of the pawl 50. In the same manner excessive displacement of the pawl 52 is prevented by a stop pin 62 secured to frame 2. In this manner, when the feed shaft 32 is inserted again into the predetermined position on the frame 2 together with the ratchet wheel 34, the pawls 50 and 52 are separated by the ratchet wheel 34 to assume the original position. In the same manner, the pawl 51 is provided with a stopper 51*a* adapted to engage the lever 55 and the frame portion 2*c* is provided with a stop pin 63 adapted to engage the pawl 53.

The reel driving mechanism is constructed to removably support the ratchet wheel 43. A stopper 64 is adjustably mounted on the frame 2 for limiting the displacement of the operating lever 54 biased by the spring 58.

As shown in FIG. 3 an interlocking pin 55*b* is secured to the pawl operating lever 55 to pass through an opening 2e formed through the frame 2 for limiting the displacement of the lever 55 biased by spring 59.

The take-up driving mechanism is constructed to drive the ratchet wheel 43 so as to take up the recording medium 20 fed by a predetermined length by the feed mechanism on the reel 28. In order to tightly wind the recording medium 20 about the reel 28, the lever 55 is displaced corresponding to the feed length of the recording medium 20. More particularly, when the diameter of the roll of the wound recording medium 20 is minimum, the lever 55 is displaced by a maximum amount by the spring 59 whereas when the diameter of the roll reaches a permissible maximum, the amount of displacement of the lever 55 becomes minimum. One end of a first link 70 is pivotally connected to the lever 54 by a pivot pin 54b and the other end is pivotally connected to a second link 71 through a pivot pin 70a. The opposite end of the second link 71 is pivotally connected to the upper end of a third link 72 through a pivot pin 71a. The central portion of the second link 71 is pivotally connected to an operating lever 73 through a pin 73a. The operating lever 73 is rotatably supported by the frame 2 by a stationary pin 74. When the operating lever 73 is rotated in the counter-clockwise direction, energy is stored in the springs 58 and 59 whereas when the operating lever 73 is rotated in the clockwise direction, the energy of the springs 58 and 59 is released. The displacement of the lever 73 is transmitted to the levers 54 and 55 through the links 71, 70 and 72. The distance between the stationary shaft 57 which is the fulcrum of the lever 55 and the interlocking pin 55b which is the operating point is made to be larger than the distance between the stationary shaft 56 constituting the fulcrum of the lever 54 and the pin 54b constituting the operating point of the lever 54 so as to make equal the distance between the fulcrum of the levers 54 and 55 and the points at which the driving pawls 50 and 51 are connected. For this reason, when the operating lever 73 is rotated in the counterclockwise direction, the second link 71 is rotated about the pivot pin 70a in the same direction whereby the pin 55b of the lever 55 is urged against the upper edge of the opening 2e through the third link 72 against the force of the spring 59. Continued displacement of the operating lever 73 in the counterclockwise direction causes clockwise rotation of the second link 71 about the pin 71a thereby rotating the lever 54 in the counterclockwise direction through the first link 70 against the force of the spring 58.

The cover 29 is provided with a stopper 75 adapted to engage the pawl 50. While the lever 54 is engaging the stopper 64 (this condition is called waiting state), even when the ratchet wheel 34 is urged to rotate in the clockwise direction, the pawl 50 would not disengage the teeth of the ratchet wheel 34 because the pawl 50 is arrested by the stopper 75.

Let us now describe means for feeding the roll of the recording medium 20. As shown in FIG. 2, a driving lever 80 is pivotally connected to the frame portion 2a by a pin 81. One end of the lever 80 engages the upper surface of the operating lever 73 while the other end carries a cam follower roller 80a which is urged against the periphery of a driving cam 82 secured to the cam shaft 16. The driving cam 82 has the same shape as the cam 15 for driving the printing bed 9. The cam 82 is displaced from the cam 15 a predetermined phase angle.

The printer of this invention operates as follows.

At first the first recording medium 6 is inserted in the space 5a to overlie the second recording medium 20. At this time the two recording media 6, 20 are clamped between the feed roller 7 and the follower roller 8. Then, in response to a printing command from outside, the driving motor 18a is started to rotate the cam shaft 16 (refer to FIG. 2) in the clockwise direction through worm 18 and worm wheel 17. As the cam 15 rotates, the driving member 12 for the printing bed 9 is rotated in the counterclockwise direction by the spring 14. At the same time, the printing bed 9 is raised by the roller 9b mounted on the angle member 10 against the force of the spring 13. The printing bed 9 urges the recording media 6 and 20 against the lower surface of the positioning member 4. At this time, the upper surface of the recording medium 6 faces to the lower end of the printing head 1 with a desired gap therebetween as shown in FIG. 1. When the driving member 12 for the printing bed 9 is displaced by the spring 14, the follower roller 80a of the lever 80 is caused to ride on the cam 82 to move the operating lever 73 from the waiting position to the preparation position shown by dotted lines 73' against the forces of the springs 58 and 59. Under a light load condition in which the driving member 12 is urged against cam 15, the cam 82 functions to store energy in the springs 58 and 59. When the cam follower 12a on the driving member 12 comes to engage the low portion 15b of the cam 15 and when the cam follower roller 80a on the driving lever 80 reaches a high portion 82a of the driving cam 82, the cam shaft 16 is stopped by an external command.

Figure 6:
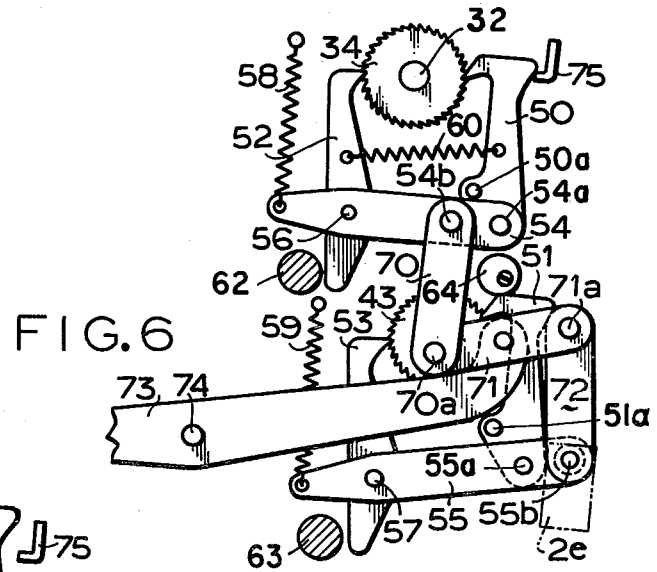
FIGS. 6 and 7 are side views useful to explain the operation of the conveyor means.

The operating lever 73 is brought to the preparation position 73' in the above described manner. Thus, as shown in FIG. 3, as the operating lever 73 rotates in the counterclockwise direction, the second link 71 is rotated about the pin 70a in the counterclockwise direction to rotate the lever 55 against the force of the spring 59 until the pin 55b engages the upper edge of the opening 2e. Since the counterclockwise or reverse rotation of the ratchet wheel 43 is prevented by the pawl 53 as shown in FIG. 6, the driving pawl 51 can rotate to the take up preparation position shown in FIG. 3 without rotating the reel 28 in the reverse direction, and energy is stored in the spring 59. Continued rotation of the operating lever 73 in the counterclockwise direction rotates the second link 71 about the pin 71a in the clockwise direction thereby moving the lever 54 through the first link 70. Accordingly, the pawl 50 is brought to the feed preparation position shown in FIG. 7 against the force of the spring 58. In this manner, the counterclockwise rotation of the operating lever 73 for storing energy in the spring 58 for the purpose of feeding the recording medium 20 is completed.

When the printing head 1 prints letters or symbols on the recording media 6 and 20 now being urged against the positioning member 4 through the inking ribbon 3, the cam shaft 16 is rotated again in the clockwise direction. Accordingly, the cam 15 for driving the printing bed 9 returns the driving member 12 to the original position from the printing preparation position 12' against the force of the spring 14. Rotation of the driving member 12 in the clockwise direction returns to the original position the printing bed 9 which is urged against the driving member 12 through the roller 9b by the parallel leaf springs 11 and the spring 13. Thus, the recording media 6 and 20 are released from the positioning member 4 and the printing bed 9 so that they can be conveyed.

Figure 7:
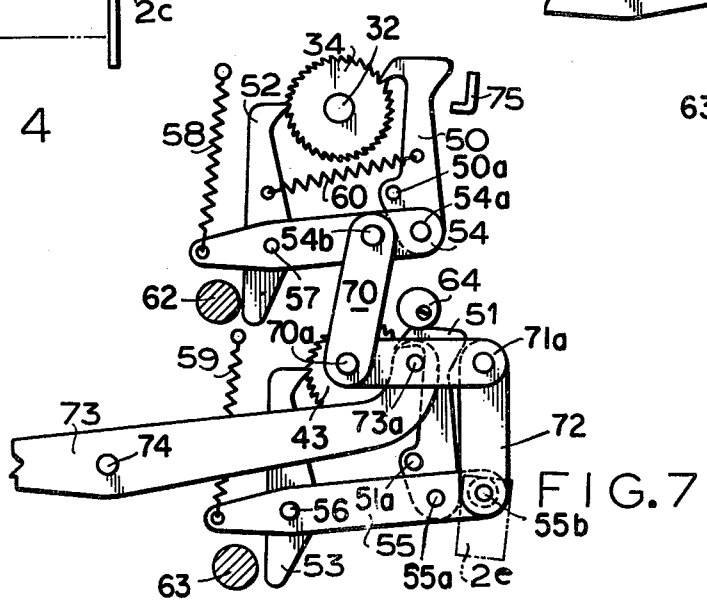

Continued rotation of the cam shaft 16 returns the printing bed 9 to the original position by the cam 15 thereby returning the operating lever 73 to the original position from the position 73' for preparing conveyance by the cam 82 and the lever 80. As shown in FIGS. 3 and 7, the rotation of the operating lever 73 in the clockwise direction is effected by the discharge of the energy of the springs 58 and 59. More particularly, since the lever 73 is normally urged by the springs 58 and 59, as the cam 82 (FIG. 2) rotates the operating lever 73 begins to rotate in the clockwise direction. The lever 54 rotates the ratchet wheel 34 in the clockwise or forward direction through the pawl 50 under the bias of the spring 58 until it is stopped by the stopper 64 so as to feed the recording medium 20 a predetermined length. Thereafter, the lever 55 begins to rotate in the clockwise direction by the energy discharged from the spring 59 thus taking up the recording medium 20 fed by the driving mechanism about the reel 28.

The lever 55 continues to rotate under the action of the spring 59 until the recording medium 20 becomes tensioned between the feed mechanism and the reel 28. The amount of rotation of the lever 55 corresponds to the length of the recording medium 20, thus conveyed. This amount varies in accordance with the diameter of the roll of the recording medium 20 wound about the reel 28.

In order to tightly and neatly wind the recording medium 20 about the reel 28 it is necessary to maintain the recording medium 20 under tension between the feeding mechanism and the reel 28. To this end, the rotation of the lever 55 under the force of the spring 59 should not be limited. After the feed operation is completed, since the pawl 50 is stopped by the stopper 75, the ratchet wheel 34 cannot disengage the pawl 50 cooperating therewith. Consequently, there is no fear of excessively rotating the ratchet wheel 34 through the recording medium 20 due to the residual driving force of the mechanism for driving the reel 28.

Before storing energy in the springs 58, 59 by the rotation of the operating lever 73 from the waiting position to the conveyance preparation position, energy is stored in the take-up reel driving mechanism. This is necessary to prevent undesired rotation of the ratchet wheel 34 caused by the residual driving force of the take-up reel driving mechanism which is applied when the pawl 50 disengages the ratchet wheel 34 while the pawl 50 is moving from the waiting position to the conveyance preparation position.

Referring again to FIG. 2 when the cam 82 brings the lever 80 to the original position from the dotted line position 80', the cam shaft 16 is stopped thus completing one cycle of operation in which printing is made and the recording media 6, 20 are conveyed. With this embodiment it is possible to perform two cycles by one revolution of the cam shaft 16.

Concurrently with the conveyance of the second recording medium 20, the first recording medium 6 is also conveyed by the rollers 7, 8. Thus, one cycle of operation of printing and feeding the first recording medium 6 is also completed.

During printing and conveyance operations the recording medium 20 is moved while it is maintained in contact with the printing bed 9. However, since the recording medium 20 passes about the guide rollers 23 and 24 supported by the printing bed 9 even when the recording medium 20 is a self-coloring paper, it does not slide on the surface of the printing bed 9 thus preventing contamination of the colored surface.

When the recording medium 20 is wound about the reel 28, the cover 29 is removed from the frame 2 together with the pressing roller 27. Then, the supporting member 30 is rotated about the pivot pin 31 together with the feed shaft 32 thereby enabling the operator to remove the reel 28 from frame portion **2*c***.

Then, the flange 44 is removed from the shaft 48. Then it is possible to move the movable member 46 in a direction to reduce the diameter of the reel 28 so that it is possible to remove the tightly wound roll of the recording medium 20 in the axial direction. To mount a roll of the recording medium 20 to be printed on the printer the roll is mounted on the frame portion **2*d* such that it will be held by the holding rollers 85, and one end of the recording medium 20 is passed through the recess 9*a* successively through the guide rollers 21, 22, 23 and 24. The end is then wound up about the reel 28 (now dismounted from the frame 2) after passing around the supporting member 30 which is now displaced to form an opening. After mounting the reel 28 on the predetermined position (refer to FIG. 4) of the frame portion 2*c* the supporting member 30 is brought to the original position and then the shaft 32 is brought back to the original position on the frame 2 thus connecting the shaft 32 and the reel 28 to respective driving means. The recording medium 20 is placed under tension sufficient to satisfactorily print letters thereon by rotating the adjusting flange 45 mounted on the reel 28 in the clockwise direction. Then, the cover 29 is reapplied to clamp the recording medium 20 between the rollers 26 and 27**.

As above described, the printer of this invention can be operated by a single driving means common to the driving mechanism for the printing bed 9 and the mechanism for conveying the recording medium 20. Accordingly, it is not necessary to use a plurality of discrete motors or solenoids thereby simplifying the circuitry, increasing the efficiency and reducing the cost. Further, the printing bed 9 is provided with a recess **9*a* through which the recording medium 20 can pass so that different from the prior art design in which the recording medium 20 is wound about the driving means of the conveyer means shown in FIG. 2, it is possible to reduce the size of the printer. Moreover, as the energy stored in spring means is used to drive the printing bed 9 for maintaining the recording medium 20 at a desired position with respect to the printing head 1, even when the thickness of the recording medium 20 is large there is no fear of overloading the direct drive as in the prior art machine in which the recording medium 20 is raised by a cam driven by the direct drive. The conveyer driving mechanism is also actuated by spring means, so that it is possible to store energy in the spring means when the load of the direct drive is small. This averages the load of the direct drive and can reduce the rating thereof. Since the conveyer of the recording medium 20 comprises feed means for feeding a predetermined length of the recording medium 20 and take-up means for winding the recording medium 20** fed thereby the accuracy of the conveyor can be improved.

Although the invention has been shown and described in terms of a preferred embodiment it should be understood that many changes and modifications will be obvious to one skilled in the art without departing the true spirit and scope of the invention as defined in the appended claims.

What is claimed is:

1. A recording medium feeding apparatus for a printer comprising (a) a frame;

(b) a feeding mechanism comprising feed means for feeding a recording medium to the printer, a feed shaft supported by said frame, a first ratchet wheel mounted on said feed shaft, feed driving means, a first pawl engaging said feed driving means and said first ratchet wheel providing forward rotation of said first ratchet wheel and a second pawl engaging said first ratchet wheel for preventing reverse rotation of said first ratchet wheel;

(c) a take up mechanism comprising take up means for taking-up the recording medium from the printer, a take up shaft connected to said frame, a second ratchet wheel mounted on said take up shaft, take up driving means, a third pawl engaging said take up driving means and said second ratchet wheel for providing a forward rotation of said second ratchet wheel and a fourth pawl for preventing a reverse rotation of said second ratchet wheel;

(d) coupling means consisting of a link mechanism for coupling said feed driving means with said take up driving means;

(e) power driving means connected to said coupling means for providing power through said coupling means to said feed driving means and said take up driving means; and (f) means for storing resilient force including a first spring means coupled to said feed driving means, and a second spring means coupled to said take up driving means whereby resilient power for application to said first and third pawls for providing rotation of said first and second ratchet wheels is stored.

2. The printer according to claim 1 wherein said coupling means comprises a first link connected to said feed driving means, a second link connected to said take up driving means and a third link interconnecting said first and second links and operated by said power driving means.

3. The printer according to claim 2 which further comprises first stop means provided near said first pawl and a tiltable pawl operating member comprising said feed driving means for limiting the rotation thereof in a clockwise direction and second stop means provided near said third pawl and a tiltable pawl operating member comprising said take up feeding means for limiting the rotation thereof in said clockwise direction and a counterclockwise direction.

4. The printer according to claim 1 which further comprises first supporting means for removably supporting said feed shaft on said frame.

5. The printer according to claim 4 wherein said first supporting means comprises a notch formed in the frame of the printer and a tiltable bearing locking member for receiving said feed shaft.

6. The printer according to claim 1 further comprising supporting means for removably supporting said take up shaft on said frame.

7. The printer according to claim 6 wherein said supporting means comprises an opening formed in the frame.

8. The printer according to claim 1 wherein the take up means comprises a cylindrical drum having an axial opening for inserting said take up shaft, an adjusting flange on one end of said cylindrical drum, the position of said adjusting flange being adjustable in accordance with the width of said recording medium, a movable member with one end pivotally connected to said adjusting flange for defining a gap between said cylindrical drum and said movable member for receiving the edge of said recording medium.

9. The printer according to claim 8 wherein said adjusting flange is provided with an opening for receiving said movable member and said cylindrical drum, a bushing surrounding said opening, and means for coupling said adjusting flange to said cylindrical drum through said bushing.

10. A printer comprising a printing head, a printing bed opposing said printing head and movable toward and away from said printing head, means for driving said printing bed so as to resiliently hold a recording medium to be printed by said printing head at a predetermined waiting position, means for feeding said recording medium a predetermined length, feed driving means for driving said feeding means by resilient force, take up means for taking up the recording medium fed by said feeding means, take up driving means for driving said take up means by resilient force and a common power means for storing energy in said means for driving said printing bed, said feeding means and said take up driving means.

11. The printer according to claim 10 wherein said power means comprises cam means for storing resilient force in said feed driving means and said take up driving means while the resilient force stored in said means for driving said printing bed is discharged to hold said recording medium at a predetermined printing waiting position.

12. The printer according to claim 10 wherein said printing bed comprises an opening for passing said recording medium, a receiving means for receiving the printing pressure applied by said printing head to said printing bed, and guide rollers arranged in parallel with said receiving means.

* * * * *